United States Patent [19]

Deming et al.

[11] 4,226,026

[45] Oct. 7, 1980

[54] DUAL ENERGY INPUT CYCLE FOR A DRYER

[75] Inventors: Charles P. Deming, Watervliet Township, Berrien County; Norbert J. Rybarczyk, Jr., Lincoln Township, Berrien County; Alvin E. Burkall, Coloma Township, Berrien County, all of Mich.

[73] Assignee: Whirlpool Corporation, Benton Harbor, Mich.

[21] Appl. No.: 21,079

[22] Filed: Mar. 16, 1979

[51] Int. Cl.[3] ..... F26B 21/10; F26B 3/04

[52] U.S. Cl. ..... 34/31; 34/45; 34/48; 34/133; 219/413; 219/492

[58] Field of Search ..... 219/354, 413, 483, 486, 219/487, 488, 492, 493; 34/45, 46, 48, 133, 30, 31; 432/24, 18, 103, 49

[56] References Cited

U.S. PATENT DOCUMENTS

| | | | |
|---|---|---|---|
| 2,863,224 | 12/1958 | Zehrbach . | |
| 3,093,722 | 6/1963 | Schauer, Jr. | 219/413 |
| 3,116,983 | 1/1964 | Chafee, Jr. . | |
| 3,229,380 | 1/1966 | Worst . | |
| 3,397,461 | 8/1968 | Fogt et al. . | |
| 3,508,340 | 4/1970 | Kombol . | |
| 3,576,661 | 4/1971 | Dekoekkoer | 34/31 |
| 3,612,500 | 10/1971 | Cramer | 34/48 |

*Primary Examiner*—Larry I. Schwartz

*Attorney, Agent, or Firm*—Hill, Van Santen, Steadman, Chiara & Simpson

[57] ABSTRACT

A method and apparatus for drying clothes wherein a clothes dryer is operated at a low level of energy input for a major portion of a drying cycle, followed by a high energy input for a short period near the end of the drying cycle. A single heater provides both levels of energy input, and has associated control means to operate the heater at the different input levels. For example, an electric heater element is controlled by cam actuated switches to operate at two levels of voltage input or a gas burner is provided with two solenoid actuated valves which are also controlled by cam actuated switches to operate the burner at two different levels of fuel input.

10 Claims, 5 Drawing Figures

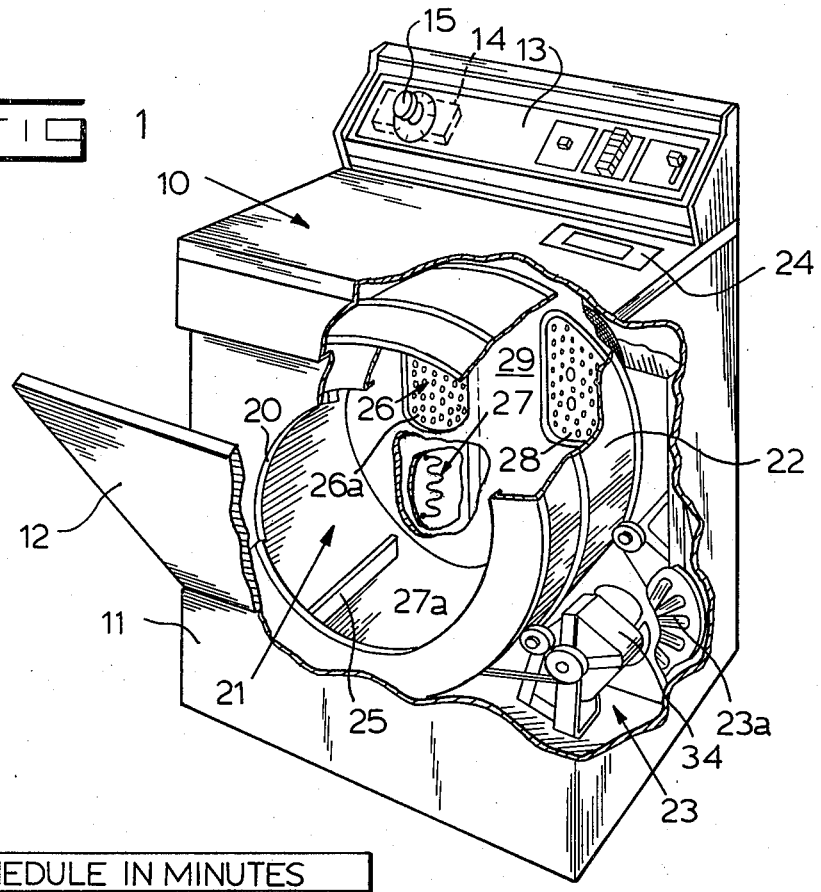
FIG 1
FIG 3
| TIMER SCHEDULE IN MINUTES | | | | |
|---|---|---|---|---|
| SWITCH CLOSED | TIMED | OFF | AIR | OFF |
| 41 | 187 | | | |
| 38 | 206 | | 36 | |
| 39 | 200 | | | |
| 40 | 12 | | | |
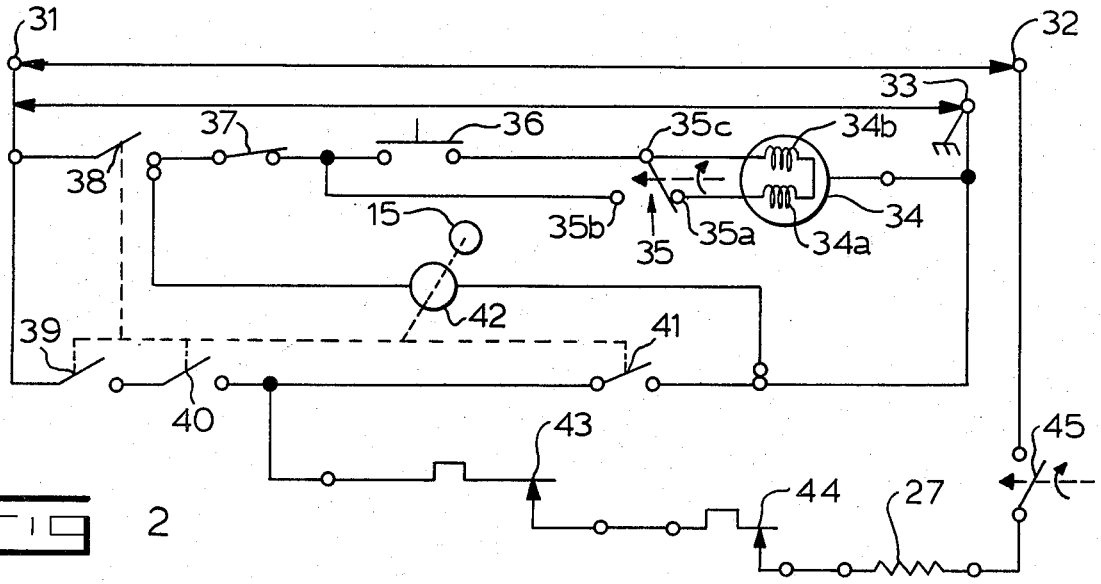
FIG 2

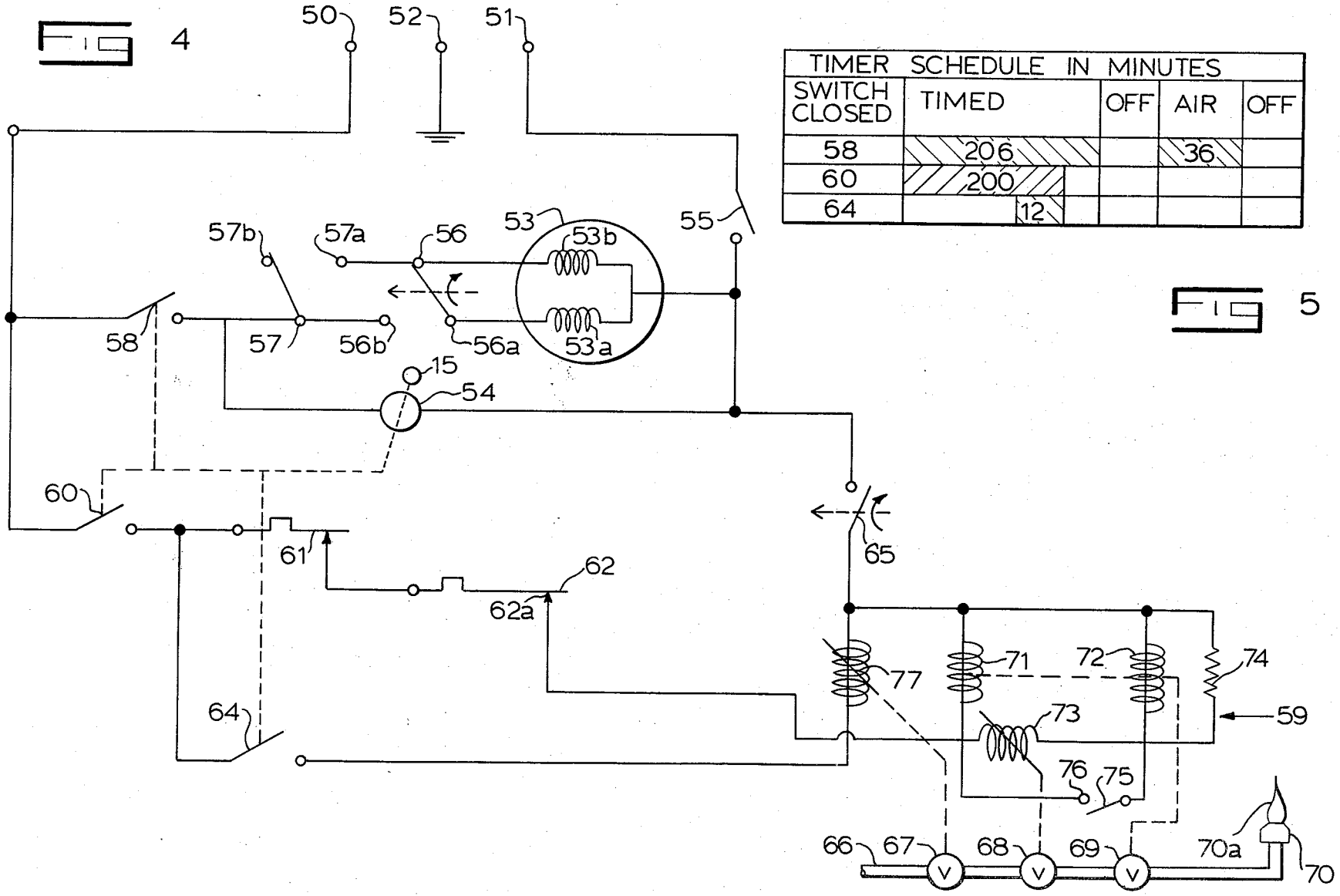
TIMER SCHEDULE IN MINUTES
SWITCH CLOSED
TIMED
OFF
AIR
OFF
58
60
64
206
200
12
36
5
4
50
51
52
53
53a
53b
54
55
56
56a
56b
57
57a
57b
58
60
61
62
62a
64
65
66
67
68
69
70
70a
71
72
73
74
75
76
77
59
15

DUAL ENERGY INPUT CYCLE FOR A DRYER

BACKGROUND OF THE INVENTION

1. Field of the Invention

This invention relates to automatic clothes drying machines and more particularly to a method and apparatus for operation of such a machine at dual energy input levels.

2. Description of the Prior Art

Operation of clothes drying appliances at different temperatures during a drying cycle is known in the art. A high level of temperature is generally employed for fast drying and a lower level is provided for efficient drying, utilized less power input. When dual heat operation is utilized, such as in U.S. Pat. Nos. 3,508,340 and 2,863,224, the period of high heat operation is followed by a period of low heat operation. It is the teaching of the art that such a sequence is to be followed to provide relatively efficient drying followed by gradually cooling down of the dryer so that a relatively low temperature level is present at the end of the cycle. However, the most efficient drying is shown in U.S. Pat. No. 3,116,983 where a low heat 120 volt input is utilized over the entire cycle.

Many machine washable clothes currently available are chemically treated to exhibit permanent press charcteristics. The permanent press process does not prevent the clothes from wrinkling, but rather acts to smooth out wrinkles in the clothes when the clothes are elevated to a certain temperature. Thus, when permanent press clothes are dried in a conventional dryer having a cycle of low heat input only, the clothes generally are not elevated to a sufficiently high temperature to activate the de-wrinkling properties of the permanent press treatment. Since with a low heat input constituting the entire cycle of operation there is generally not a sufficient temperature rise to activate the permanent press treatment, the permanent press clothes emerge from such a conventional low heat drying cycle with wrinkles.

SUMMARY OF THE INVENTION

An automatic clothes drying appliance is provided with a dual energy input cycle and apparatus which operates a drying cycle at a low energy input level for a majority of the cycle and a high energy input level for a small portion of the cycle at the end of the total drying period. Dryers utilizing an electric heating element are provided with a plurality of cam actuated switches driven by a timing motor. The cams operate switches to control associated circuitry so that the heating element is energized at 120 volts for the majority of the drying cycle and at 240 volts for a period at the end of the drying portion of the cycle.

Dryers utilizing a gas burner are provided with at least two solenoid actuated valves connected to a gas supply which are also controlled by cam operated switches moved by a timing motor. The switches are activated to open at least one gas valve during the entire drying portion of the dryer cycle, and to change the second gas valve from a low heat to a high heat opening during a portion of the cycle at the end of the drying portion.

DESCRIPTION OF THE DRAWINGS

FIG. 1 is a perspective view, partly broken away, of an automatic clothes drying appliance.

FIG. 2 is a schematic diagram of a dual energy input circuit for an electric heating element.

FIG. 3 is a schedule showing the operation of various switches in FIG. 2 during a drying cycle.

FIG. 4 is a schematic diagram of a dual energy input means for a gas burner.

FIG. 5 is a schedule showing operation of various switches in FIG. 4 during a drying cycle.

DESCRIPTION OF THE PREFERRED EMBODIMENT

An automatic clothes drying appliance is shown generally at 10 in FIG. 1. The dryer 10 has a cabinet 11 having a hinged door 12 opening on a front thereof. The dryer 10 has a control panel 13 having a control dial 15 which is user-operable to selectively set a control device 14 for various drying cycles of operation, as for example, a timed drying cycle.

A flange 20 in the front of the cabinet 11 defines a receptacle opening 21 through which clothes may be deposited in a rotatable drum 22. The drum has radially inwardly extending vanes 25 mounted on an interior surface thereof, and is rotated by a suitable drive means 23.

A rear wall 29 of the dryer, against which drum 22 rides in air sealing relationship, has an air inlet 26 and an air outlet 28 therein. A perforated wall **26*a* extends vertically within inlet 26 and is mounted to an inlet air duct 27*a*. Within the inlet duct 27*a* is a heating element shown generally at 27. The perforations in the wall 26*a* allow the heat from the heating element 27 to enter the drum 22 through the perforations. Outlet 28 is formed by perforations in rear wall 29. Air is circulated from the surroundings through duct 27*a*, heated by element 27 and then through inlet 26, through the drum 22 to the outlet 28 by a fan 23*a* driven by the drive means 23. It will be understood that the heating element 27 in duct 27*a* may be electrical element or a gas burner. Where the heating element comprises a gas burner, the burner may be located below the drum 22 and the duct 27*a* extended to form an air communication channel between the burner and the inlet 26**.

The dryer 10 may also be provided with a removable lint trap 24. It will be understood that positioning of the various elements in the dryer 10 as shown in FIG. 1 is for illustrative purposes only, and the elements need not occupy the position shown.

A circuit diagram for operation of the dryer of FIG. 1 at two energy input levels is shown in FIG. 2. The circuit has two input terminals 31 and 32 and a grounded input terminal 33. A low level input voltage, such as 120 volts, may be applied between the input terminals 32 and 33 or 31 and 33, and a high voltage input level, such as 240 volts, may be applied between the input terminals 31 and 32.

A drive motor 34 is connected to a single pole-double throw centrifugal switch 35 which is in a position making contact with a terminal **35*a* when drive motor 34 is at rest. Thus, a start winding 34*a* and a run winding 34*b* are connectable in parallel to a source of potential at pole 35*c*. Closure of a biased normally open push-to-start switch 36 by a user causes connection of the drive motor 34 across the 120 volt supply from terminal 31, closed switches 38 and 37 (hereinafter explained), through switch 36, pole 35***c*, contact 35*a* and motor 34 windings 34*a* and 34*b* to terminal 33. Rotation of the motor 34 as thus connected causes the pole of centrifugal switch 35 to move from contact 35*a* to 35*b*, thus maintaining energization of motor run winding 34*b* through switches 37 and 38 even though switch 36 is released. A door switch 37 is open whenever the door 12 is open, thus insuring that operation of the dryer 10 will not be initiated with the door 12 open.

Rotation of timer dial 15 or operation of a timer motor 42 operates a number of rotating cams (not shown) within control 14 which push against spring contacts to make and break cam operated switches 38, 39, 40 and 41 in the manner well known to those versed in the art. Thus, the switches can be set by a user of a dryer to selected positions by dial 15 and made or broken at selected intervals during the dryer cycle by timer motor 42.

A suggested schedule of operation of the cam operated switches is shown in FIG. 3, indicating the relative on-off positions of switches 28, 29, 40 and 41 during a cycle of operation. The numbers noted thereon indicate a suggested maximum duration in minutes that each switch remain closed during the cycle. Rotation of control dial 15 determines the actual duration selected by positioning the cams with respect to switches 38, 39, 40, 41 in a conventional manner. The numbers are suggested durations only, and variations can be effected without departing from the concept of this invention. The sequence of opening and closing is, however, necessary for proper operation in order to obtain the advantages contemplated by this invention.

During a low level energy input portion of the drying cycle, the control dial 15 is set to close the switches 38, 39 and 41. Once these switches are set, timer motor 42 through switch 38 is connected to electrical potential at terminals 31, 33 and begins operation to sequence the switches as shown in FIG. 3. Closure of the push-to-start switch 36 begins operation of the drive motor 34 as previously explained. Movement of the motor 34 closes aother centrifugal switch 45 so that heater element 27 is energized at 120 volts from terminal 33 through closed switch 41, a pair of normally closed thermostats 43 and 44, through the heater and the closed switch 45 to terminal 32. Thermostat 43 is provided to control the maximum operating temperature and thermostat 44 is a safety thermostat to insure that heater operation will be discontinued if the temperature moves above a preselected over heat level.

After operation at 120 volts for a selected amount of time, the timer motor 42 moves cams to open the switch 41 and thereafter to close the switch 40. The cams are positioned to open the switch 41 slightly before closing the switch 40, and are also positioned to "fast make" the contact of switch 40 to energize heater 46 with 240 volts to reduce contact arcing of the switch 40. With this arrangement of switches, the heater 46 is energized at a high level energy input of 240 volts from terminal 31, through closed switches 39 and 40 and thermostats 43, 44 through the heater and centrifugal switch 45 to terminal 32.

After a relatively short period of operation in the 240 volt mode redundant switch 39 provides a "fast break" of the 240 volt circuit to heater 27. The rotation of the cams in control 14 "fast breaks" the switch 39 to reduce contact arcing and then opens switch 40. The drying portion of the cycle ends but the drum 22 continues to rotate with no heat provided, allowing the clothes and drum to cool. The cycle ends when the timer motor 42 rotates to cause the opening of switch 38, and the subsequent cessation of rotation of the drive motor 34 again opens the centrifugal switches 45 and 35.

A schematic circuit diagram showing a dual energy input apparatus for a gas dryer is shown in FIG. 4. Operation of the circuit shown in FIG. 4 is in many respects similar to operation of the circuit of FIG. 2. The apparatus of FIG. 4 has input terminals 50 and 51, and a grounded terminal 52. A suitable voltage level, such as 120 volts, may be placed across the terminals 50 and 51.

A motor 53 has a run winding 53*b* and a start winding 53*a* which are connected in parallel during starting of the motor 53 by way of a centrifugally operated switch 56, having stationary contacts 56*a* and 56*b*. A push-to-start switch 57 is manually operated to move from a stationary contact 57*b* to a second stationary contact 57*a*.

Manual pre-setting of dial 15 of a timer motor 54 and cams (not shown) in control 14 closes cam operated switches 58 and 60 in a conventional manner, so that operation of the push-to--start switch 57 to contact 57*a* actuates the motor 53. Upon sufficient rotation of the motor 53 the contact 56 transfers from the contact 56*a* to remove the starting winding from the circuit and engages stationary contact 56*b*. Thus, even though push-to-start switch 57 returns to contact 57*b* when released, an operating path for the run winding 53*b* is provided from terminal 50 through switch 58, contacts 56*a* and 56, run winding 53b and a door operated switch 55 to terminal 51.

The door safety switch 55 is open whenever the door 12 is open, to prevent operation of the dryer when the door 12 is open. Another centrifugal switch 65 closes when the motor 34 has attained a sufficient angular velocity.

Operating thermostat 61 and safety thermostat 62 are provided to control the amount of heat for drying similar to thermostats 43 and 44 previously discussed in FIG. 2.

Operation of the cam operated switches 58, 60 and 64 by rotation of timer dial 15 or timer motor 54 is shown in the schedule of FIG. 5 with suggested maximum durations similarly indicated as in FIG. 3. The switches control the flow of fuel to a gas burner apparatus 59 including a burner 70. The burner 70 receives fuel from an input pipe 66. Fuel flow in the pipe 66 is controlled by a series of valves 67, 68 and 69. Electrical potential is provided to the gas burner apparatus after motor 53 operation has begun by way of closed switch 60, and normally closed thermostats 61, 62 from terminal 50 and closed door switch 55 and centrifugual switch 65 from terminal 51.

The gas burner apparatus 59 includes a pair of windings 71 and 72 for controlling the opening and closing of valve 69. The energizing potentials supplied across windings 71 and 72 from switch 65 and the contact 62*a* of the thermostat 62, and by way of normally closed contacts 75 and 76, energize the windings to open the valve 69. At the same time, these energizing potentials are being supplied to an igniter 74 which may be constructed of a silicon carbide composition and which is energizable to glow and provide an ignition temperature for the gas. The gas from the supply is, however, prevented from reaching the vicinity of the igniter 74 by a closed valve 68. The opening and closing of the valve 68 is controlled by the energization and de-energization of a winding 73 which is shunted by the closed contacts 75 and 76. The contact 75 is temperature sensitive and opens in response to the attainment of an ignition temperature by the igniter 74 to remove the shunt across the windings 73 and to permit energization thereof to open the valve 68 and to permit gas flow to the burner to produce a flame 70a.

A valve 67 is also provided in series in the gas circuit. This valve 67 is a two-level valve which is normally closed in a flow restricting condition to provide a first quantity of gas to the burner, and is operable under the control of a winding 77 to a fully open condition to provide a greater quantity of gas flow to the burner. Winding 77 is connected to a source of potential through switches 64 and 60 to terminal 50, and through centrifugal switch 65 and switch 55 to terminal 51. The winding 77 is de-energized in the initial portion of the drying cycle because switch 64 is open as shown in the schedule of FIG. 5.

During the initial portion of the drying cycle the windings 71, 72 and 73 are energized to open the valves 68 and 69 and the winding 77 is not energized so that the valve 67 provides a restricted quantity of fuel to the burner to provide a low level of heat output, for example 10,000 BTU/Hr. Near the completion of the drying cycle as shown in the schedule of FIG. 5, switch 64 is closed under control of the timer motor 54 to operate the gas burner at a high level of heat output through energization of winding 77. This high level of heat output may be, for example, 25,000 BTU/Hr.

The timer motor continues operation to complete the cycle and open all switches, thereby ceasing drying and rotation of the drum 22.

Although changes and modifications may be apparent to those versed in the art, it is applicant's intention to embody within the patent warranted hereon all such changes and modifications which are reasonably and properly within the scope of applicants' contribution to the art.

The embodiments of the invention in which an exclusive property or privilege is claimed are defined as follows:

1. In a dryer having a means for directing a flow of air for drying a clothes load over a period of time during a preselected programmed cycle of operation, and a heater for raising the temperature of said air, a control means for said heater comprising:

a first means for providing a low thermal output from said heater during a first portion of said cycle of operation;

a second means for providing a high thermal output at a level sufficient to de-wrinkle permanent press fabrics from said heater for a second portion of said cycle of operation; and a third means for automatically changing sequentially from said low to said high thermal output with no intervening decrease in thermal output at a selected time during said cycle of operation so that a relatively higher energy input occurs near the end of the cycle to enhance de-wrinkling of permanent presstype fabrics.

2. The dryer of claim 1, wherein said heater is a resistance heater:

said first means includes circuitry operable to connect said resistance heater to a 120 VAC source during said first portion of said cycle of operation;

said second means includes circuitry operable to connect a 240 VAC source to said resistance heater during said second portion of said cycle; and said third means comprises a timer motor for operating cam actuated switches in said circuitry for connection and disconnection of said voltage sources in a programmed sequence.

3. The dryer of claim 2, wherein said first means includes circuitry for disconnecting said 120 VAC source from said heater, and said second means includes circuitry for fast connecting said 240 VAC source in place of said 120 VAC source and for fast disconnecting said 240 VAC source at the end of said second portion of said cycle.

4. In a dryer having a means for directing a flow of air for drying a clothes load during a pre-selected cycle of operation, a rotatable drum for containing said clothes load, a drive means for rotating said drum, and a resistance heater for raising the temperature of said air from a normal drying temperature to a level sufficient to de-wrinkle permanent press fabrics, a means for selectively connecting said heater to a 120 VAC source and a 240 VAC source comprising:

a timer motor rotating to operate a plurality of cam operated switches;

a first of said cam operated switches connected to said heater and said drive means, said first switch remaining closed during a first low temperature portion of said cycle of operation and a second high temperature portion of said cycle of operation to operate said drive means;

a second of said cam operated switches connected to said heater and said first switch, said second switch closed during said low temperature portion and opened by said timer motor to disconnect said 120 VAC source from said heater; and a third of said cam operated switches connected to said heater, said third switch closed to fast connect said 240 VAC source to said heater immediately following disconnection of said 120 VAC source so that a relatively higher energy input occurs near the end of the cycle to enhance dewrinkling of permanent press-type fabrics.

5. The dryer of claim 4 including a fourth of said cam operated switches connected to said third switch to fast disconnect said 240 VAC source from said heater.

6. The dryer of claim 4 wherein said 240 VAC source is connected to said heater by said third switch means for a period of time sufficient to provide heat within said drum to raise the temperature of a permanent press clothes load to a given temperature to cause de-wrinkling of said load.

7. In a dryer having a gas fueled means for elevating the temperature of an airstream directed through a treatment zone:

a source of electrical potential;

a first and a second solenoid actuated valve for regulating the supply of gas fuel to the temperature elevating means;

a timer motor for operating a plurality of cam actuated switches in a programmed sequence;

a first of said cam operated switches for connecting said first solenoid actuated valve to said potential source to open said first valve; and a second of said cam operated switches for connecting said second solenoid actuated valve to said electric potential to increase said supply of gas fuel to said temperature elevating means to provide air temperature sufficient to de-wrinkle permanent press fabrics;

said timer motor sequencing said switches such that said first cam actuated switch is closed during a first low temperature portion of said cycle of operation and a second high temperature portion of said cycle of operation to maintain said first valve open, and immediately following said first low temperature portion of said cycle said second cam actuated switch is closed during said second high temperature portion of said cycle of operation to increase said supply of gas fuel, whereby an increased energy level is produced in said second portion of said cycle to enhance de-wrinkling of permanent press-type fabrics.

8. A method of operating a clothes dryer having a heating means through a programmed drying cycle of operation comprising:

energizing said heating means at a low input to provide a low thermal output during a first portion of said cycle of operation;

immediately switching to a higher input to said heating means with no intervening decrease in thermal output;

energizing said heating means at said higher input to provide a higher thermal output sufficient to de-wrinkle permanent press fabrics over a second portion of said cycle of operation so that said relatively higher energy output occurs near the end of the cycle to enhance de-wrinkling of permanent press-type fabrics.

9. A method of operating a dryer having a resistance heater for providing a heated flow of air to a clothes load during a programmed cycle of operation, said method comprising:

connecting said heater to a 120 VAC source to provide a low energy level output to said clothes load during a first portion of said cycle of operation;

disconnecting said heater from said 120 VAC source at an end of said first portion of said cycle of operation;

connecting said heater to a 240 VAC source to provide a higher energy level output to said clothes load sufficient to de-wrinkle permanent press fabrics at a beginning of a second portion of said cycle of operation immediately following said first portion of said cycle and with no intervening decrease in said energy level; and operating said heater from said 240 VAC source during a remainder of said cycle of operation so that a relatively higher energy output occurs near the end of the cycle.

10. A method of operating a clothes dryer having a gas burner for providing a heated flow of air to a clothes load during a programmed cycle of operation, said method comprising:

supplying fuel at a first rate to provide a low heat output level during a first portion of said cycle of operation; and supplying fuel at a second increased rate immediately following said first portion of said cycle with no intervening decrease in said heat output level to provide a second, higher heat output level sufficient to de-wrinkle permanent press fabrics during a second portion of said cycle of operation, so that a relatively higher energy output occurs near the end of the cycle to enhance de-wrinkling of permanent press-type fabrics.

* * * * *